US006342474B1

(12) United States Patent
Kerobo et al.

(10) Patent No.: US 6,342,474 B1
(45) Date of Patent: Jan. 29, 2002

(54) HARD SURFACE CLEANER CONTAINING NONIONIC SURFACTANTS

(75) Inventors: Charles O. Kerobo, Southfield, MI (US); Richard J. Holland, Flanders, NJ (US); Michael C. Welch, Woodhaven, MI (US); Suzanne M. Gessner, Ypsilanti, MI (US); Sonia J. Patterson, Detroit, MI (US)

(73) Assignee: BASF Corporation, Mount Olive, NJ (US)

( * ) Notice: Subject to any disclaimer, the term of this patent is extended or adjusted under 35 U.S.C. 154(b) by 0 days.

(21) Appl. No.: 09/466,291

(22) Filed: Dec. 17, 1999

Related U.S. Application Data

(63) Continuation-in-part of application No. 09/345,212, filed on Jun. 30, 1999, now abandoned.

(51) Int. Cl.[7] ..... C11D 1/66

(52) U.S. Cl. ..... 510/405; 510/475; 510/505; 510/477; 510/238

(58) Field of Search ..... 510/405, 180, 510/191, 199, 238, 239, 243, 245, 244, 421, 477, 488, 475, 505

(56) References Cited

U.S. PATENT DOCUMENTS 4,020,016 A * 4/1977 Sokol ..... 510/362
5,252,245 A 10/1993 Garabedian, Jr. et al.
5,382,376 A * 1/1995 Michael et al. ..... 510/413
5,437,807 A 8/1995 Garabedian, Jr. et al.
5,454,984 A 10/1995 Graubart et al.
5,468,423 A * 11/1995 Garabedian, Jr. et al. ... 510/423
5,501,816 A 3/1996 Burke et al.
5,536,452 A * 7/1996 Black ..... 510/238
5,575,864 A 11/1996 Haley et al.
5,585,342 A 12/1996 Choy et al.
5,587,022 A 12/1996 Black
5,814,591 A * 9/1998 Mills et al. ..... 510/238
5,853,430 A * 12/1998 Shindo et al. ..... 8/137
5,854,193 A 12/1998 Mondin et al.
5,912,220 A * 6/1999 Sramek et al. ..... 510/284
6,147,037 A * 11/2000 Gardlik et al. ..... 510/107

OTHER PUBLICATIONS

BASF 1993 Techincal Bulletin, "Lime Soap Removal Test Methods and Results." B. Potthoff–Karl, SOFW vol. 120, pp. 104–109, 1994, "Neue Biologisch Abbaubare Komplexbildner." No Month.

PTO 98–1640, "New Biodegradable Complexing Agents: Understanding the Structure–Degradation Effect." Feb. 1998, 40$^{th}$ Annual SEPAWA Conference, Bad Durkheim. (the English Text Corresponds to that of the Potthoff–Karl Article).

* cited by examiner

*Primary Examiner*—Cynthia H. Kelly
*Assistant Examiner*—Dawn L. Garrett
(74) *Attorney, Agent, or Firm*—David T. Banchik, Esq.

(57) ABSTRACT

There is provided an aqueous hard surface cleaning composition comprising a) a water soluble organic solvent;

b) a nonionic surfactant selected from the group consisting of an alcohol alkoxylate, an alcohol block alkoxylate, a polyxyethylene polyoxypropylene block surfactant, and mixtures thereof; and c) an effective amount up to about 5% by weight of a cleaning auxiliary selected from the group consisting of methylglycine diacetic acid, hydroxyethyl ethylenediamine triacetic acid, diethylenetriamine pentaacetic acid, ethylenediamine tetraacetic acid, nitilotriacetic acid, salts thereof, and mixtures thereof; and d) optionally, a thickening agent. The compositions are useful for cleaning hard surfaces with a minimum of wiping and scrubbing.

20 Claims, No Drawings

HARD SURFACE CLEANER CONTAINING NONIONIC SURFACTANTS

CROSS-REFERENCE TO RELATED APPLICATIONS

This application is a continuation-in-part of application Ser. No. 09/345,212, filed on Jun. 30, 1999. now abandoned

FIELD OF THE INVENTION

The invention relates to a hard surface cleaner containing nonionic surfactants, and especially to a cleaner effective at removing soap scum and other deposits without wiping or scrubbing.

It is desirable that a hard surface cleaner for cleaning bathtub, shower, and bathroom surfaces be effective at removing soap scum and other deposits. The cleaner should readily remove the deposits, and leave the cleaned surfaces streak free. It is further desirable that the cleaner work with a minimum of wiping and scrubbing by the person cleaning the surface.

It is further desirable that the cleaner should be effective on a variety of materials which are found in bathrooms, such as porcelain, glass, and various plastics such as polyvinyl chloride as found in shower curtains, or styrenics as might be found in shower liners.

Applicants have surprisingly found that a composition comprising an organic solvent, a nonionic surfactant, and a cleaning auxiliary is useful for accomplishing the above desirable goals.

BACKGROUND OF THE INVENTION

Mills, U.S. Pat. No. 5,814,591, provides aqueous hard surface cleaners with nonionic surfactants, ammonium EDTA, and an organic solvent.

Choy, U.S. Pat. No. 5,585,342 provides an aqueous hard surface cleaner containing solvent and a semipolar nonionic surfactant, buffered to a pH greater than 6.5.

Graubart, U.S. Pat. No. 5,454,984, provides a cleaning composition containing a quaternary ammonium compound component, a nonionic surfactant, and a glycol ether component, with optional chelators.

Sokol, U.S. Pat. No. 4,020,016, provides aqueous cleaning compositions containing one or more nonionic surfactants, nitrogen containing salts of nitrilotriacetic acid or an alkylene polyamine polycarboxylic acid, and water, wherein the composition is substantially free of sodium ions.

Garabedian, U.S. Pat. No. 5,252,245 and U.S. Pat. No. 5,437,807, provides an aqueous hard surface cleaner containing an alkanol or alkylene glycol ether; a surfactant selected from amphoteric, nonionic, and anionic surfactants or mixtures thereof; and an effective amount of a nitrogenous buffer. To avoid streaking, sodium ions are avoided and the amount of surfactant is kept to a minimum.

Garabedian, U.S. Pat. No. 5,468,423, provides an aqueous hard surface cleaner containing an alkanol or alkylene glycol ether, a nonionic surfactant, and an effective amount of a nitrogenous buffer.

Black, U.S. Pat. No. 5,536,452 and U.S. Pat. No. 5,587,022, provides an aqueous rinsing solution composition and a method of use of the same without scrubbing or wiping, wherein the composition contains a nonionic surfactant having an HLB of 13 or less, a chelating agent, and optionally an alcohol and/or ammonium hydroxide and/or morpholine.

Michael, U.S. Pat. No. 5,382,376, discloses detergent compositions comprising a nonionic detergent surfactant, a hydrophobic solvent, and optionally comprising polycarboxylate detergent builders.

SUMMARY OF THE INVENTION

There is provided according to the invention a novel hard surface cleaning composition comprising a) a water soluble organic solvent;

b) a nonionic surfactant selected from the group consisting of an alcohol alkoxylate, an alcohol block alkoxylate, a polyoxyethylene polyoxypropylene block surfactant, and mixtures thereof;

c) an effective amount up to about 5% by weight of a cleaning auxiliary selected from the group consisting of methylglycine diacetic acid, hydroxyethyl ethylenediamine triacetic acid, diethylenetriamine pentaacetic acid, ethylenediamine tetraacetic acid, salts thereof, and mixtures thereof; and d) optionally, a thickening agent.

In one embodiment, the invention is a nonaqueous blend comprising the components above. In another embodiment, the invention is an aqueous concentrate comprising the above components, ready for dilution as needed to the end use concentration. In yet another embodiment, the invention is an aqueous solution comprising the above components, diluted to the end use concentration for direct use by the ultimate consumer.

DETAILED DESCRIPTION OF A PREFERRED EMBODIMENT OF THE INVENTION

The compositions of the invention are useful as aqueous hard surface cleaners, and are especially suited to cleaning vertical surfaces of soap scum and similar debris, with a minimum of wiping and scrubbing. As such, the compositions are intended to be applied to the vertical surfaces by spraying from a pump sprayer bottle, aerosol can, or other delivery system onto the vertical surface, and allowing the compositions to drain away and/or evaporate from the surface, leaving the surface clean and streak free. It is acknowledged that originally the surface may be so soiled with soap scum and related debris that the user may need to do some scrubbing to remove the soil, but thereafter the compositions are designed so as to minimize the amount of wiping and scrubbing when applied daily or after each shower. It is therefore contemplated that the compositions of the invention will advantageously be used to clean shower surfaces on a daily basis, or after each shower.

As such, the compositions of the invention all perform satisfactorily in a soak test, described below, which measures the ability of the compositions to clean a surface without wiping or scrubbing. The performance of the compositions of the invention is comparable to or exceeds the performance of commercially successful cleaning compositions. Preferred compositions perform well in a series of streak tests on different materials to be found in a shower or bath environment.

As discussed above, the compositions of the invention include aqueous solutions of the components discussed in detail below. The compositions of the invention are also useful as component blends such as would be made for shipping to a bottler or packager for further processing to make the compositions ultimately used by the consumer. The invention also covers concentrated aqueous solutions of the components, such as might be shipped from a blending facility to another location for further dilution to the end concentrations to be used by the consumer. The compositions of the invention are also useful when diluted with water to the final use concentrations discussed below.

Optional ingredients may be added to the novel compositions of the invention, without departing from the scope. Such optional ingredients are well known to those of skill in the art, and include but are not limited to colorants, fragrances, preservatives, buffering agents, and antibacterial agents.

A detailed description of the components of the invention is as follows:

a) The Water Soluble Organic Solvent

The organic solvent useful in the invention enhances the cleaning performance by causing the compositions to rinse better or to drain more readily from vertical surfaces. The solvent can also increase the evaporation rate of the cleaning composition, which reduces streaking and leads to a glossier looking surface. Thus the organic solvent is to be chosen based on its solubility in water, and its having sufficient volatility to perform well in cleaning. Preferred solvents have a solubility of greater than about 20 percent by weight in water to facilitate the formulation of the aqueous concentrates of the compositions noted above. More preferably, the solvents are more than 30 percent soluble in water. The greatest formulation flexibility is achieved when the solvent is miscible with water. Therefore, miscible organic solvents are also preferred. Further, it is naturally desirable that the solvent be non-toxic and have a non-offensive odor. Useful solvents are described in U.S. Pat. No. 5,814,591 and U.S. Pat. No. 5,585,342, the descriptions of which are hereby incorporated by reference.

Within the above parameters, a wide range of solvents is useful. Typical, but non-limiting examples are selected from $C_{1-6}$ alkanol, $C_{1-6}$ diols, $C_{3-24}$ alkylene glycol ethers, and mixtures thereof. The alkanol can be selected from methanol, ethanol, n-propanol, isopropanol, butanol, pentanol, hexanol, their various positional isomers, and mixtures of the foregoing It may also be possible to utilize in addition to, or in place of, said alkanols, the diols such as methylene, ethylene, propylene and butylene glycols, and mixtures thereof. Other suitable solvents include acetone, butanone, N-methylpyrrolidone, alkyl ethers of alkylene glycols, alkanolamines, N-alkyl alkanolamines, low molecular weight ketones, and water soluble alkyl pyrrolidones. It is preferred to use an alkylene glycol ether solvent in this invention. The alkylene glycol ether solvents can include ethylene glycol monobutyl ether, ethylene glycol monopropyl ether, propylene glycol n-propyl ether, propylene glycol monobutyl ether, dipropylene glycol methyl ether and mixtures thereof. Preferred glycol ethers are ethylene glycol monobutyl ether, also known as butoxyethanol, sold as buty Cellosolve by Union Carbide, and also sold by Dow Chemical Co., 2-(2-butoxyethoxy) ethanol sold as butyl Carbitol, also by Union Carbide, and propylene glycol n-propyl ether, available from a variety of sources. Another preferred alkylene glycol ether is propylene glycol t-butyl ether, which is commercially sold as Arcosolve PTB, by Arco Chemical Co. The n-butyl ether of propylene glycol is also preferred.

Examples of less desirable solvents are methanol because of its toxicity, and watersoluble carboxylic acids such as acetic acid and butyric acid as well as water-soluble organic amines because of their objectionable odor. Some solvents may be so volatile that their use is less preferred. An example in the latter category is acetone.

Two solvents preferred for their blend of desirable properties such as commercial availability, water solubility, low toxicity, no objectionable odor, and good performance in cleaning are isopropyl alcohol and the monobutyl ether of ethylene glycol.

b) The Nonionic Surfactant

The nonionic surfactant is preferably selected from the group consisting of alcohol alkoxylates, alcohol block alkoxylates, polyoxyethylene polyoxypropylene block surfactants, and mixtures thereof. Surfactants with a wide range of hydrophile-lipophile balance (HLB) can be used in the invention. The nonionic surfactant preferably will have an HLB of greater than about 13, and more preferably greater than or equal to about 14.

As is well known in the art, the alcohol alkoxylates are made by using an alcohol as an initiator molecule, and polymerizing an alkylene oxide or a mixture of alkylene oxides onto the initiator molecule to form a first block. Thereafter, a second alkylene oxide or mixture of alkylene oxides can optionally be added to form a second block. Third and subsequent blocks can also be added. Generally, the only proviso is that adjacent blocks have different relative alkylene oxide compositions.

Alcohol alkoxylates are commercially available, for example as the Plurafac® surfactants of BASF Corporation. One example is surfactants represented by the general formula $$R—(oxide1)_a—OR'$$

where R is the alkyl residue of an alcohol which has 6 to 24 carbon atoms; a represents the average number of alkylene oxide units in the structure; oxide 1 is an alkylene oxide selected from the group consisting of ethylene oxide, propylene oxide, butylene oxide, and mixtures thereof; and where R' is hydrogen, an alkyl group with 1 to 18 carbon atoms, a hydroxyalkyl group, or a mixture thereof As used herein, butylene oxide refers to any of 1,2-butylene oxide, 2,3-butylene oxide, and isobutylene oxide, and to each of them. Here and throughout the specification, it is to be understood that R and R' can also refer to mixtures of alcohols or alkyl groups. These surfactants are made by adding the alkylene oxide or mixture of alkylene oxides to an alcohol R—OH. Useful surfactants are obtained when a is less than or equal to about 30. It is more preferable that a be less than about 20. The oxidel is preferably a heteric blend of ethylene oxide and propylene oxide, with ethylene oxide being present at greater than 50%, preferably at greater than 70% of the total number of the alkylene oxide units in the structure. The R group preferably has from about 8 carbons to about 16 carbons, and more preferably from about 10 to about 16 carbons. A preferred surfactant is one where R contains 10 to 12 carbon atoms, R' is hydrogen and a is about 15, where of the 15 units of alkylene oxide, about 13 are ethylene oxide and about 2 are propylene oxide.

Also useful are the diblock and the diblock alcohol alkoxylates. The diblock alcohol alkoxylates can be represented as $$R—(oxide1)_a—(oxide2)_b—OR'$$

while the triblock alcohol alkoxylates can be represented as $$R—(oxide1)_a—(oxide2)_b—(oxide3)_c—OR'$$

where R is an alkyl or aralkyl group containing 6 to 24 carbon atoms; oxide1, oxide2, and oxide3 each represent an alkylene oxide selected from the group consisting of ethylene oxide, propylene oxide, butylene oxide, and mixtures thereof, with the proviso that the relative alkylene oxide composition of oxide2 differ from that of oxidel and oxide3;

a, b, and c are each from about 1 to 35; and R' is hydrogen, an alkyl group with 1 to 18 carbon atoms, a hydroxyalkyl group with 1 to 18 carbon atoms, or a mixture thereof.

Examples of useful alcohol block alkoxylates are the diblock alcohol alkoxylates where the blocks are essentially all ethylene oxide or essentially all propylene oxide. These can be represented by the general formulas $$R—(eo)_a—(po)_{b—OR'}$$

or $$R—(po)_a—(eo)_b—OR'$$

where R is the alkyl or aralkyl residue of an alcohol containing 6 to 24 carbon atoms; a and b are each from 1 to about 30; eo represents an ethylene oxide unit; po represents a propylene oxide unit; and R' is hydrogen, an alkyl group with 1 to 18 carbon atoms, a hydroxyalkyl group with 1 to 18 carbon atoms, or a mixture thereof.

One class of polyoxyethylene polyoxypropylene block surfactants useful in the invention is the triblock surfactants represented by the general formula $$R—(eo)_a—(po)_b—(eo)_c—R'$$

where a, b, and c each represent the number of ethylene oxide or propylene oxide units in each of the blocks, and where R and R' are independently H, $C_{1-18}$ alkyl, $C_{1-18}$ hydroxyalkyl, or a mixture thereof. Members of this class of surfactants are commercially available as the Pluronic® surfactants of BASF Corporation.

When such a triblock surfactant is subjected to further reaction with propylene oxide so that polyoxypropylene groups are added to the ends of the triblock surfactant, there is obtained another useful polyoxyethylene polyoxypropylene block surfactant , which can be represented in a similar fashion as $$R—(po)_a—(eo)_b—(po)_c—(eo)_d—(po)_e—R'$$

where a, b, c, d, and e each represent the number of ethylene oxide or propylene oxide units in each of the blocks, and where R and R' are independently H, $C_{1-18}$ alkyl, $C_{1-8}$ hydroxyalkyl, or a mixture thereof.

Preferred polyoxyethylene polyoxypropylene block surfactants include those where a, b, c, d, and e have values such that the number average molecular weight of the polyoxyethylene polyoxypropylene block surfactant is from about 1800 to about 6000, more preferably from about 2000 to about 4000. The block surfactants are preferably comprised of about 20% to about 60% by weight of polyoxyethylene blocks, and more preferably from about 25% to about 50%. A preferred block surfactant is a five-block polyoxyethylene polyoxypropylene surfactant having a molecular weight of about 3200, and wherein the polyoxyethylene blocks comprise about 34% of the total weight.

c) The Cleaning Auxiliary

Cleaning auxiliaries useful in the present invention include methylglycine diacetic acid (MGDA), ethylenediamine tetraacetic acid (EDTA), N-hydroxyethyl ethylenediamine triacetic acid, diethylenetriamine pentaacetic acid, and nitrilotriacetic acid, as well as salts of the above. Mixtures of the above are also useful. Useful salts include alkali metal salts, alkaline earth salts, ammonium salts, amine salts, alkylamine salts, and alkanolamine salts. Useful alkali metal salts include sodium and potassium. The salts useful in the invention can be monovalent, divalent, trivalent, tetravalent, or pentavalent. For example, where sodium is the counterion, examples of EDTA salts useful in the invention include sodium EDTA, disodium EDTA, trisodium EDTA, and tetrasodium EDTA.

Similarly, as illustration, the pentasodium salts of diethylenetriamine pentaacetic acid may be used.

The salts, including alkali metal salts, of the cleaning auxiliary may be added to the cleaning composition in their salt form. Alternatively, the free acid form of the cleaning auxiliary may be added, and the salts may be formed in situ by addition of a neutralizing basic compound, for example an alkali metal hydroxide. Finally, the compositions of the invention may be adjusted to a desired pH by addition of buffering agents. An advantage of compositions of the present invention is that they are not sensitive to the presence of sodium ions. Therefore, common alkali metal containing materials, such as sodium hydroxide and sodium containing buffering agents, can readily be used to adjust the pH.

Preferred cleaning auxiliaries include MGDA, EDTA, their salts, and mixtures thereof. A preferred salt is the sodium salt, because of its ready commercial availability. Examples of preferred cleaning auxiliaries include sodium EDTA and sodium MGDA.

d) The Thickening Agent

The compositions of the invention optionally and advantageously contain a thickening agent. The thickening agent increases the viscosity of the aqueous compositions of the invention, which leads to desirable wetting, drainage, and retention times on the vertical surfaces on which they are applied.

Water-soluble thickeners useful in the invention include cellulose thickeners, water-soluble gums, and acrylic polymers. Examples include carboxymethyl cellulose, carboxyethy cellulose, Irish moss, gum tragacanth, starch, hydroxyethypropylcellulose, hydroxybutyl methyl cellulose, hydroxypropylmethyl cellulose, hydroxyethyl cellulose (e.g., available as Natrosol®, a water soluble polymer of Hercules, Inc.), sodium carboxymethyl cellulose, poly (methyl vinyl ether/maleic anhydride) available for example as Gantrez® AN139 (GAF Corporation), and carboxyvinyl polymer for example available as Carbopol® 934, Carbopol® 940, or Carbopol® 941 (B.F. Goodrich). Other suitable water soluble thickeners include the general class of polyoxyalkylenes. These can include high molecular polyethylene glycols, as well as alkoxylates of polyfunctional alcohols such as ethylene glycol, glycerol, trimethylolpropane, pentaerythritol, and the like.

A preferred thickening agent is the class of nonionic associative thickeners. These are described for example in U.S. Pat. Nos. 4,904,466, 4,810,503, 4,673,518, 4,411,819, 4,649,224, 4,665,239, and 4,709,099, the disclosures of which are hereby incorporated by reference. As is known in the art, these thickeners are made by reacting an epoxide compound of about 6 carbons or greater with a polyoxyalkylene polyol. Useful epoxides are those with 6 carbons up to those with 20 to 45 carbon atoms. A wide range of polyoxyalkylene polyols can be used and can be diols, triols, or higher functionalities. The product of the reaction is a polyol that has large alkyl groups at its termini, the large alkyl groups being the alkyl groups on the epoxides noted above. It is believed that in aqueous solution the large alkyl groups associate with one another to form micelle like structures, which form an extensive network throughout the solution and act to increase the viscosity.

Preferred nonionic associative thickeners are those with detergent properties. Detergent properties can be built into the associative thickener by choosing a polyoxyalkylene polyol for the reaction described in the preceding paragraph which itself has detergent properties. A polyoxyalkylene polyol has detergent properties when it has a relatively more hydrophobic part and a relatively more hydrophilic part. It is common to introduce these hydrophobic and hydrophilic parts into polyoxyalkylene polyols by preparing the polyols with blocks of polyoxyalkylenes, where adjacent blocks have different relative alkylene oxide concentrations. This principle, which is well known to those of skill in the art, is illustrated by the discussion above of the nonionic surfactants useful in the invention.

Useful nonionic associative thickeners used in the Examples are Pluracol® AT 299 and Pluracol® AT 301, available commercially from BASF Corporation.

Formulating the Components of the Invention

To make the compositions of the invention, the ingredients above are combined together by means well known in the art. The relative levels of the ingredients are selected to give the required performance of the composition in a hard surface cleaning application, with an eye toward making sure on the one hand that a component is present at a sufficient level to be effective, but on the other hand that excessive cost is avoided by limiting the upper range of the component.

Given the above considerations, Applicants have found that the organic solvent (a) is advantageously used at a level of from about 0.1 to about 10 parts by weight; that the nonionic surfactant (b) is useful at levels from about 0.5 to about 10 parts by weight; and that the cleaning auxiliary (c) can be used at an effective amount up to about 5 parts by weight. When a thickening agent is added, it can be present at from about 0.1 to about 10 parts by weight, more preferably from about 0.2 to about 10 parts by weight.

By combining the ingredients at the above levels, one obtains useful hard surface cleaning compositions especially suited to be diluted with water and used to clean bathroom and other surfaces of soap scum and other deposits with a minimum of wiping and scrubbing.

As noted above, another object of the invention is to provide aqueous concentrates of the components of the invention. To this end, water is added to the blend of components, which components are present in the ranges of parts by weight given above. Water can be added up to an amount where the percentage by weight composition of components a), b), c), and optionally d) in the water containing composition is numerically equal to the parts by weight of the components given above. Another way of saying this is to note that water can be added to a blend comprising components a), b), c), and optionally d) up to an amount where sum of the concentrations of all the components, including the water, adds up to 100 parts by weight. It is readily seen then that the parts by weight given above for the components a), b), c), and optionally d) are numerically equal to the percent by weight composition in the aqueous composition.

For many reasons, it may be desirable to add water to components a), b), c), and optionally d), but to add less water than needed to dilute the components to their final end use concentration. For example, it may be desirable to add half the water or less so as to make a cleaning concentrate that can be shipped to a customer for further dilution with water and bottling or packaging for the consumer. Thus the invention covers concentrates comprising components a), b), c), optionally d), and water.

The preferred compositions to be discussed below refer to percents by weight in the final aqueous solution to be used by the consumer. Based on the discussion above, they refer equally to the parts by weight of the components in the non-aqueous blend.

The water-soluble organic solvent (a) can be used at any effective level. Preferably the level will be from about 0.1% to about 10%. The upper level is somewhat arbitrary, but as a practical matter, the amount of solvent should be limited based on cost and volatility considerations. More preferably, the solvent is present at a level from about 1% to about 10%, and most preferably from about 2% to about 6%.

The nonionic surfactant is in general present at levels from about 0.1% to about 10%. Higher levels would probably be effective in performance, but would be less desirable because of cost considerations. Preferably, the nonionic surfactant is above about 0.2%, and more preferably above about 0.5%.

The cleaning auxiliary is present at an amount in the compositions of the present invention such that on dilution to the final end use concentration, the cleaning auxiliary will be present at an effective amount. In the final end use concentration for use by the ultimate consumer, the minimum level of cleaning auxiliary will in general be above about 0.1%. It is preferable that the minimum amount be about 0.25% or greater, and more preferable that the minimum level be above about 0.4%. Likewise, the maximum level should be selected so that the cleaning auxiliary is present in an effective amount. It is further limited by cost considerations. Generally, it is preferred to use up to about 5% of the cleaning auxiliary. Preferably, up to about 3% should be used. All percentages of cleaning auxiliary refer to the present by weight in the composition fully diluted with water to the end use concentration for use by the ultimate consumer.

The compositions of the invention may optionally contain additional ingredients that are conventional additives found in cleaning compositions. Such ingredients may include fragrances, dyes, and preservatives. Furthermore, the compositions of the invention may be adjusted with mineral acids or organic acids to attain a desired pH, or they may contain buffering systems to hold the pH steady at a desired level.

EXAMPLES

A parent soil recipe is first made with the following ingredients

| | |
|---|---|
| Ivory ® bar soap | 3.90% by weight |
| Shampoo (a) | 0.35 |
| Clay soil (b) | 0.06 |
| Artificial sebum (c) | 0.15 |
| Hard water (d) | 95.54 |

(Ivory® is a registered trademark of Procter & Gamble Co.)

Notes:

(a) A simple, moderate-cleaning commercial shampoo containing alkyl ethoxysulfates is recommended. A suitable shampoo is Johnson & Johnson's Baby Shampoo, which can be purchased at retail stores. Shampoos containing conditioning or treatment additives should be avoided.

(b) Ball or bandy black clay supplied by H. C. Spinks Co., Paris TN is suitable for this purpose.

(c) Spangler, et al., "A Laboratory Method for Testing Laundry Products for Detergency," JAOCS, Vol. 42, Aug. 1965, pp. 723–727.

(d) 20,000 ppm, 2:1 calcium:magnesium, as $CaCO_3$, using calcium chloride dihydrate and magnesium chloride hexahydrate.

Procedure

1. Shave bar soap and place in suitable beaker.
2. Add the remainder of the components, in order, and stir with a three-blade propeller mixer.
3. Warm the entire mixture to 45–50° C.
4. Mix until a smooth suspension is achieved.
5. Filter the suspension through a Buchner funnel fitted with Whatman# filter paper.
6. Resuspend the entire filtrate soil in deionized water using the same volume of water that was used to make the soil.
7. Dry the filtrate cake overnight in a 45° C. oven.
8. Pulverize the dry cake and keep in a closed container away from ambient moisture. This is the parent soil.

Next, a reconstituted soil is made from the parent soil.

| | |
|---|---|
| Parent soil | 4.50% by weight |
| Hard water (as above) | 9.00 |
| HCl (37%) | 0.77 |
| acetone | 85.73 |

1. Combine the above ingredients.
2. Homogenize the suspension until its color turns from white to gray.

Soak test

First, ceramic tiles are prepared by washing, drying, and cooling at room temperature; airbrushing 0.1–0.15 g of reconstituted soil onto the tiles; baking at approximately 320° C. for 2 minutes; and cooling overnight at room temperature.

To perform the soak test, the tiles prepared as in the preceding paragraph are soaked in the test formula for 5 minutes, and the percent clean is evaluated qualitatively.

Glass and Vinyl Cleaning

To run this test, the soil is sprayed onto a 3 inch by 8 inch piece of glass or vinyl shower curtain material. The test piece is allowed to dry for 24 hours, and is evaluated qualitatively according to the scale below. The test is repeated for 5 days, and the rating after the fifth day is reported. The qualitative test scale is

| | |
|---|---|
| 1 | very streaky; tracks from build-up |
| 2 | some streaks; light build-up |
| 3 | even distribution of a thick film |
| 4 | even distribution of a light film |
| 5 | even distribution with semi-gloss |

The higher the numeric value of the qualitative test rating, the more desirable is the result.

Results

Comparative examples 1, 2, and 3 show the performance in the soak test and in the glass tests of three formulations currently in commercial use. The formulations tested in Comparative Examples 1–3 were purchased at a local retail store. Examples 1–28 are within the scope of the current invention. It can be seen that the compositions of the invention give performance comparable to or superior to that of commercially successful products.

The examples show compositions that give a 85–100% clean rating in the soak test. Compositions within the scope of the present invention preferably should give at least about a 50% clean rating in the soak test. More preferably, the soak test results will be about 80% or higher, with the most preferable result being 100% clean.

With compositions of the current invention, results in the curtain test and the glass test should preferbally be least equal to that of the commercial products, which in this case is a 1 rating in the glass test, and a 1 or 2 rating in the curtain test.

Comparative Examples - commercially available shower cleaners

| | Clean Shower ® Blue | Clean Shower ® Yellow | Tilex ® |
|---|---|---|---|
| Comparative Example | 1 | 2 | 3 |
| pH | 4.92 | 5.06 | 11.74 |
| Soak test % clean | 100 | 100 | 100 |
| Curtain test rating | 2 | 3 | 1 |
| Glass test rating | 2 | 1 | 1 |

Clean Shower® is a registered trademark of Automation, Inc. of Jacksonville, Fla.

Tilex® is a registered trademark of The Clorox Company, Oakland Calif.

Examples 1–28

In Examples 1–28, water is added to bring the total to 100 parts. Thus, the numbers in the table represent percent by weight of the composition.

Solvent 1 is butyl Carbitol, available from Union Carbide.

Solvent 2 is isopropanol.

Thickener 1 is Pluracol® AT 301, available commercially from BASF Corporation.

Thickener 2 is Pluracol® AT 299, available commercially from BASF Corporation.

MGDA is the sodium salt of methylglycine diacetic acid.

Surfactant A is a po/eo/po/eo/po block copolymer, molecular weight about 3200, about 34% ethylene oxide. The HLB of surfactant A is 14.

The value of % clean is the result in the soak test, described above.

Curtain test rating and glass test rating are the test results from the glass and vinyl test described above.

| Component | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| Solvent 1 | | 5.4 | 4.4 | 4.4 | 3.4 | 3.4 | 5.4 | 3.4 | 4.4 | 4.4 | 5.4 | 4.4 | 3.4 | 3.4 | 3.4 |
| Solvent 2 | 4.4 | | | | | | | | | | | | | | |
| thickener 1 | 0.5 | | 0.5 | | | | 1.5 | 1.0 | 0.5 | 0.5 | 0.5 | 0.5 | 0.5 | 1.0 | 1.0 |
| thickener 2 | | 0.5 | | | | | | | | | | | | | |
| MGDA | 1.26 | 2.0 | 1.26 | 1.26 | 2.0 | .52 | .52 | .52 | 1.26 | 1.26 | .52 | .52 | 1.26 | 2.0 | 2.0 |
| Surfactant A | 2.5 | 0.5 | 1.5 | 1.5 | 0.5 | 0.5 | 0.5 | 2.5 | 2.5 | 1.5 | 2.5 | 1.5 | 1.5 | 0.5 | 2.5 |
| pH | | 11.04 | 11.04 | 11.12 | 11.22 | 10.96 | 10.6 | 10.48 | 10.92 | 10.97 | 10.7 | 10.88 | 11.07 | 11.21 | 11.2 |

-continued

| Component | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| Soak test % clean | 95 | 100 | 100 | 100 | 100 | 95 | 90 | 95 | 100 | 100 | 85 | 90 | 100 | 100 | 100 |
| Curtain test rating | | 2 | 1 | 1 | 1 | 1 | | | | | | | | | |
| Glass test rating | | 4 | 2 | 3 | 2 | 4 | | | | | | | | | |

| Component | 16 | 17 | 18 | 19 | 20 | 21 | 22 | 23 | 24 | 25 | 26 | 27 | 28 |
|---|---|---|---|---|---|---|---|---|---|---|---|---|---|
| Solvent 1 | 3.4 | 3.4 | 3.4 | 5.4 | 5.4 | 4.4 | 5.4 | 4.4 | 3.4 | 4.4 | 5.4 | 4.4 | 3.4 |
| Solvent 2 | | | | | | | | | | | | | |
| thickener 1 | 1.0 | 1.0 | 1.0 | 1.0 | 1.0 | 0.5 | 0.2 | 1.0 | | 0.5 | | | 1.0 |
| thickener 2 | | | | | | | | | | | | | |
| MGDA | .52 | 2.0 | 2.0 | .52 | .52 | 1.26 | 1.26 | 1.26 | 2.0 | 2.0 | 2.0 | 1.26 | 1.26 |
| Surfactant A | 2.5 | 0.5 | 2.5 | 0.2 | 2.5 | 0.5 | 1.5 | 1.5 | 2.5 | 1.5 | 2.5 | 15 | 0.5 |
| pH | 10.88 | 11.24 | 11.23 | 10.92 | 10.92 | 11.18 | 11.15 | 11.15 | 11.23 | 11.24 | 11.24 | 10.88 | 10.84 |
| Soak test % clean | 100 | 100 | 100 | 100 | 100 | 100 | 100 | 100 | 100 | 100 | 100 | 100 | 100 |
| Curtain test rating | | | | | | | | | | | | | |
| Glass test rating | | | | | | | | | | | | | |

Examples 29–36

Examples 29–36, including 36b, compare the performance of various polycarboxylate detergent builders to the cleaning auxiliaries of the present invention.

In Examples 29–36, the formulations are given on the basis of 500 g total. Therefore to calculate the corresponding percentages by weight, the amounts should be divided by 5. For example, in all the Examples 29–36, there are 22 g of solvent 1, corresponding to 4.4% by weight. Likewise, surfactant A, at 7.5 g, is present at 1.5% by weight in the compositions.

Curtain test rating and glass test rating are as defined in Examples 1–28.

Of all the polycarboxylate detergent builders in Examples 29–36, only tetrasodium EDTA and sodium MGDA, both cleaning auxiliaries of the present invention, give acceptable results in the soak test at a level of 0.44%. At a level of 3%, the cleaning auxiliaries of the current invention gave acceptable performance (Examples 32b, 33b, 34b, 35b, and 36b), while others gave unacceptable performance (Examples 29b, 30b, and 31b).

| | 29 | 29b | 30 | 30b | 31 | 31b* | 32 | 32b | 33 | 33b | 34 | 34b | 35 | 35b | 36 | 36b |
|---|---|---|---|---|---|---|---|---|---|---|---|---|---|---|---|---|
| Solvent 1 | 22 | 22 | 22 | 22 | 22 | 22 | 22 | 22 | 22 | 22 | 22 | 22 | 22 | 22 | 22 | 22 |
| Surfactant A | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 |
| Sodium citrate | 2.2 | 15 | | | | | | | | | | | | | | |
| Methyliminodiacetic acid | | | 2.2 | 15 | | | | | | | | | | | | |
| N-2-acetamidoiminodiacetic acid | | | | | 2.2 | 15 | | | | | | | | | | |
| Trilon C | | | | | | | 2.2 | 15 | | | | | | | | |
| Trilon D | | | | | | | | | 2.2 | 15 | | | | | | |
| Trilon M | | | | | | | | | | | 2.2 | 15 | | | | |
| Trilon A | | | | | | | | | | | | | 2.2 | 15 | | |
| Trilon BS | | | | | | | | | | | | | | | 2.2 | 15 |
| $H_2O$ | 468.3 | 453.3 | 468.3 | 453.3 | 468.3 | 453.3 | 468.3 | 453.3 | 468.3 | 453.3 | 468.3 | 453.3 | 468.3 | 453.3 | 468.3 | 453.3 |
| Soak test (% clean) | 5% | 40% | 0% | 5% | 0% | 5% | 5% | 95% | 10% | 95% | 95% | 90% | 20% | 90% | 100% | 100% |
| Curtain test rating | | | | | | | | 2 | | 2 | 1 | 1 | | 3 | 2 | 4 |
| Glass test rating | | | | | | | | 1 | | 1 | 3 | 1 | | 1 | 1 | 1 |

*The sample of Example 31b was not a homogeneous solution.

Solvent 1 and surfactant A are as defined above for Examples 1–28.

Trilon® C is pentasodium diethylenetriamine pentaacetic acid.

Trilon® D is trisodium hydroxyethyl ethylenediamine triacetic acid.

Trilon® M is the sodium salt of methylglycine diacetic acid.

Trilon® A is trisodium nitrilotriacetic acid.

Trilon® B is tetrasodium ethylenediamine tetraacetic acid.

The Trilon® products are commercially available from BASF Corporation.

We claim:

1. An aqueous hard surface cleaning composition consisting of a) a water soluble organic solvent;

b) a nonionic surfactant selected from the group consisting of alcohol alkoxylates, alcohol block alkoxylates, polyoxyethylene polyoxypropylene block surfactants, and mixtures thereof;

c) an effective cleaning amount up to about 5% by weight of a cleaning auxiliary selected from the group consisting of methylglycine diacetic acid, hydroxyethyl ethylenediamine triacetic acid, diethylenetriamine pentaacetic acid, ethylenediamine tetraacetic acid, nitrilotriacetic acid, salts thereof, and mixtures thereof;

d) water; and e) a thickening agent.

2. A cleaning composition according to claim 1, wherein said nonionic surfactant is selected from the group consisting of a) alcohol alkoxylate of general structure $$R—(\text{oxide } 1)_a—OR'$$

b) diblock alcohol alkoxylate of general structure $$R—(\text{oxide } 1)_a—(\text{oxide } 2)_b—OR'$$

c) triblock alcohol alkoxylate of general structure $$R—(\text{oxide } 1)_a—(\text{oxide } 2)_b—(\text{oxide } 3)_c—OR'$$

and mixtures thereof, wherein R is an alkyl or aralkyl group containing 6 to 24 carbon atoms; a, b, and c are each from 1 to about 35, R' is hydrogen, an alkyl group with 1 to 18 carbon atoms, a hydroxyalkyl group, or a mixture thereof, and where oxide 1, oxide 2, and oxide 3 each represent at least one alkylene oxide selected from the group consisting of ethylene oxide, propylene oxide,
butylene oxide, and mixtures thereof, with the proviso that the relative alkylene oxide composition of oxide 2 differs from that of oxide 1 and oxide 3.

3. The composition of claim 1, wherein said nonionic surfactant is selected from the group consisting of a polyoxyethylene polyoxypropylene block surfactant of the general structure $$R—(eo)_a—(po)_b—(eo)_c—R'$$

a polyoxyethylene polyoxypropylene block surfactant of the general structure $$R—(po)_a—(eo)_b—(po)—(eo)_d—(po)_e—R'$$

and mixtures thereof,
wherein R and R'are independently H, $C_{1-18}$ alkyl, hydroxyalkyl, or mixtures thereof; a, b, c, d, and e each represent the number of ethylene oxide or propylene oxide units in each of the blocks, and wherein a, b, c, d, and e have values such that the number average molecular weight of the polyoxyethylene polyoxypropylene block surfactant is from about 1800 to about 6000.

4. A cleaning composition according to claim 2, wherein the nonionic surfactant has the general formula $$R—(\text{oxide } 1)_a—OH$$

where R is an alkyl group containing 6 to 18 carbon atoms, a is from 3 to 30, and oxide 1 is an alkylene oxide selected from the group consisting of ethylene oxide, propylene oxide, butylene oxide, and mixtures thereof.

5. A cleaning composition according to claim 4, wherein oxide 1 is a mixture of ethylene oxide and propylene oxide comprising more than 50% of ethylene oxide.

6. A cleaning composition according to claim 4, wherein the mixture comprises more than 70% of ethylene oxide.

7. A cleaning composition according to claim 1, wherein said cleaning auxiliary is selected from the group consisting of methylglycine diacetic acid, ethylenediamine tetraacetic acid, salts thereof, and mixtures thereof.

8. A cleaning composition according to claim 1, wherein said cleaning auxiliary is selected from the group consisting of methylglycine diacetic acid, salts thereof, and mixtures thereof.

9. A cleaning composition according to claim 1, wherein said cleaning auxiliary is the sodium salt of methylglycine diacetic acid.

10. A composition as in claim 1, wherein said organic solvent has greater than 30% by weight solubility in water.

11. A composition as in claim 1, wherein the thickening agent is a nonionic associative thickener.

12. A composition as in claim 11, wherein the nonionic associative thickener is the reaction product of a $C_6$ or greater epoxide with a polyoxyalkylene polyol.

13. A composition according to claim 1, containing from about 1 to about 10% by weight of said organic solvent and from about 0.5 to about 10% by weight of said nonionic surfactant.

14. A composition as in claim 13, containing from about 0.1 to 10% by weight of said thickening agent.

15. A composition as in claim 1, wherein the cleaning auxiliary is present at a level of up to about 3% by weight.

16. A composition as in claim 15, wherein said cleaning auxiliary is selected from the group consisting of methylglycine diacetic acid, ethylenediamine tetraacetic acid, salts thereof, and mixtures thereof.

17. A composition according to claim 16, wherein said cleaning auxiliary is sodium salt of methylglycine diacetic acid.

18. A composition according to claim 1, wherein the hydrophile lipophile balance of said nonionic surfactant is greater than or equal to about 13.

19. A composition according to claim 1, wherein the hydrophile lipophile balance of said nonionic surfactant is greater than or equal to about 14.

20. A water dilutable cleaning composition, consisting of a) from about 1 to about 10 parts of a water soluble organic solvent;

b) from about 0.5 to about 10 parts of a nonionic surfactant selected from the group consisting of alcohol alkoxylates, alcohol block alkoxylates, polyoxyethylene polyoxypropylene block surfactants, and mixtures thereof;

c) from 0.1 up to about 5 part of a cleaning auxiliary selected from the group consisting of methylglycine diacetic acid, hydroxyethyl ethylediamine tracetic acid, diethylenetriamine pentaacetic acid, ethylenediamine tetraacetic acid, nitrilotriacetic acid, salts thereof, and mixtures thereof;

d) optionally, water, at any amount up to an amount where the weight of the composition is 100 parts; and e) from about 0.1 to about 10 parts of a thickening agent.

* * * * *